United States Patent [19]

Meurer et al.

[11] 4,127,998

[45] Dec. 5, 1978

[54] MANDREL CHANGING DEVICE FOR A PIERCING ROLLING MILL

[75] Inventors: Hans Meurer; Klaus Rehag, both of Mönchen-Gladbach, Fed. Rep. of Germany

[73] Assignee: Wean United, Inc., Pittsburgh, Pa.

[21] Appl. No.: 858,047

[22] Filed: Dec. 6, 1977

[30] Foreign Application Priority Data

Dec. 14, 1976 [DE] Fed. Rep. of Germany ..... 2657059

[51] Int. Cl.[2] ..... B21B 25/06

[52] U.S. Cl. ..... 72/97; 72/209

[58] Field of Search ..... 72/97, 208, 209, 250, 72/252

[56] References Cited

U.S. PATENT DOCUMENTS

| | | | |
|---|---|---|---|
| 1,931,571 | 10/1933 | Burn | 72/201 |
| 2,771,800 | 11/1956 | Kritscher | 72/209 X |
| 4,022,043 | 5/1977 | Chevet | 72/97 |

*Primary Examiner*—Milton S. Mehr

*Attorney, Agent, or Firm*—Daniel Patch; Suzanne Kikel

[57] ABSTRACT

The disclosure of the present invention concerns a piercing rolling mill with a mandrel changing device which has at least two groove-like recesses which can be positioned alternately in the rolling line in order to hold the mandrels, and a retractable mandrel stripper, and where the mandrel rod carries at its front end a pin on which the mandrel is attached in such a way that it is detachable against the effect of expanding springs or similar means.

8 Claims, 13 Drawing Figures

MANDREL CHANGING DEVICE FOR A PIERCING ROLLING MILL

Figure 1:
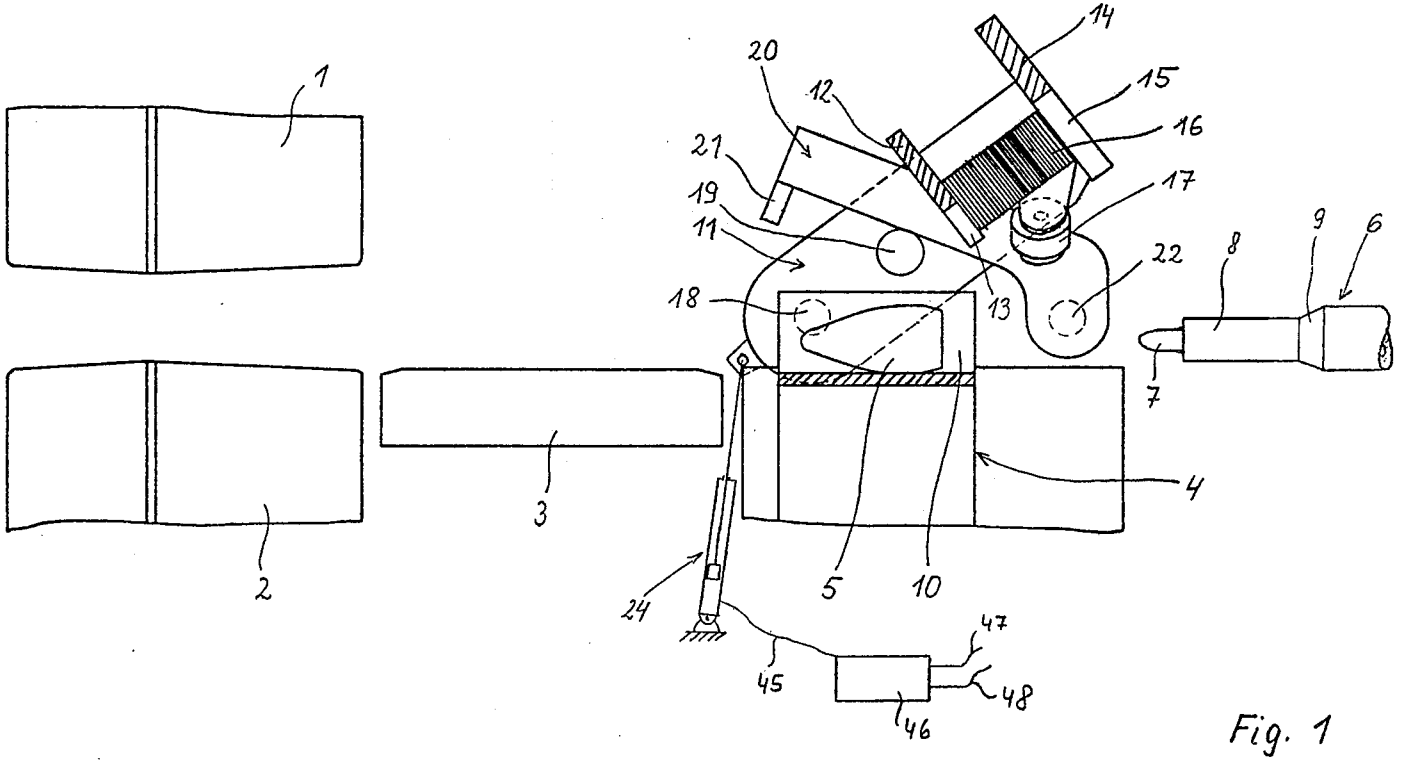

The invention is based on a mandrel changing device for known piercing rolling mills for example as shown on DT-OS 23 46 490 which is characterized among other things by the fact that the mandrel changing device is located at the delivery side of the rolling mill stand. This guarantees a fast and reliable changing of the mandrel. This is of particular importance for piercing rolling mills, since the mandrel has to be changed after each rolling cycle, in order to remove the rolled workpiece from the mandrel rod and in order to cool the mandrel. In the present case, the mandrel is removed by a retractable stripper located between the rolling mill stand and a changing cylinder; the stripper being activated by a swivel cylinder. A new mandrel is mounted after completion of the return movement of the mandrel rod and during its forward stroke, and the mass inertia of the mandrel is used for the mounting; it is therefore not necessary to hold the mandrel during mounting. This method of mounting a new mandrel is satisfactory and is utilized for a piercing rolling mill according to this invention. The invention actually concerns the stripping of the mandrel. In the case of the known mandrel changing device, the mandrel hits the stripper with its protruding end surface, whereby reaction forces may occur in unfavorable cases which throw the mandrel back in the direction of the rolling mill stand. If the mandrel comes to rest only within the range of the swivel axis of the swivel table carrying the stripper, its subsequent slipping off the swung out swivel table is at least delayed.

It is the task of the invention to avoid this disadvantage inherent in the state of the art, and to guarantee that the mandrel is stripped off fast and reliably even under vigorous stripping impacts and comes to rest in a specific position. This will also increase the return speed of the mandrel rod. Furthermore, it will avoid the releasing of the mandrel which has a negative effect on the operational cycle of the rolling mill, in that the mandrel rod, after release of the mandrel, has to move back even further for the mounting of the new mandrel.

The invention therefore suggests that, whichever recess of the two end surfaces may be positioned in the rolling line, can be covered by baffle plates falling down from above in cycle with the rolling process, whereby a rear baffle plate, serving as a stripper, is attached to a liftable first lever, which has its horizontal swivel axis perpendicular to the rolling line and in the range of the front end of the recess, and a rear baffle plate is connected to a disengageable swivel cylinder or similar device and is shaped fork-like in order to hold the part of the mandrel rod next to the mandrel, and whereby at the lower side of the lever in the rolling direction before the rear baffle plate at least one roller or similar device is attached which intermittently is in contact with a tube blank and/or the mandrel rod, and that the first lever furthermore has a cam on which a second lever rests, which carries at its front end the front baffle plate, and which has its horizontal swivel axis perpendicular to the rolling line and in the range of the rear end of the recess, and that the mandrel rod in the part next to the mandrel has a constriction whose axial extension is dimensioned in such a way, that the distance of the transition of the constriction to the normal diameter of the mandrel rod from the point of the mandrel is somewhat smaller than the distance of the roller having contact with the constriction from the swung in front baffle plate, and that its half diameter is smaller than the lateral distance between the roller and the axis of the mandrel rod or rolling line respectively.

At the moment of the stripping of the mandrel, the invention causes the groove-like recesses on both end sides to be closed to the extent that the stripping process can take place and that the removed mandrel will stay within the chamber formed by the baffle plates even if the stripping occurred with too much force. The front baffle plate prevents an unintentional motion of the released mandrel in the direction of the rolling mill stand. In addition, the stripping of the mandrel and the mounting of a new mandrel take place at the same position so that, compared to the earlier mentioned state of the art, the cycle is shortened. Furthermore, the invention avoids a complicated control of the swivelling of the baffle plates due to the fact that the special design of the mandrel-end of the mandrel rod guarantees an automatic action of the falling-in of the stripping plate.

Figure 3:
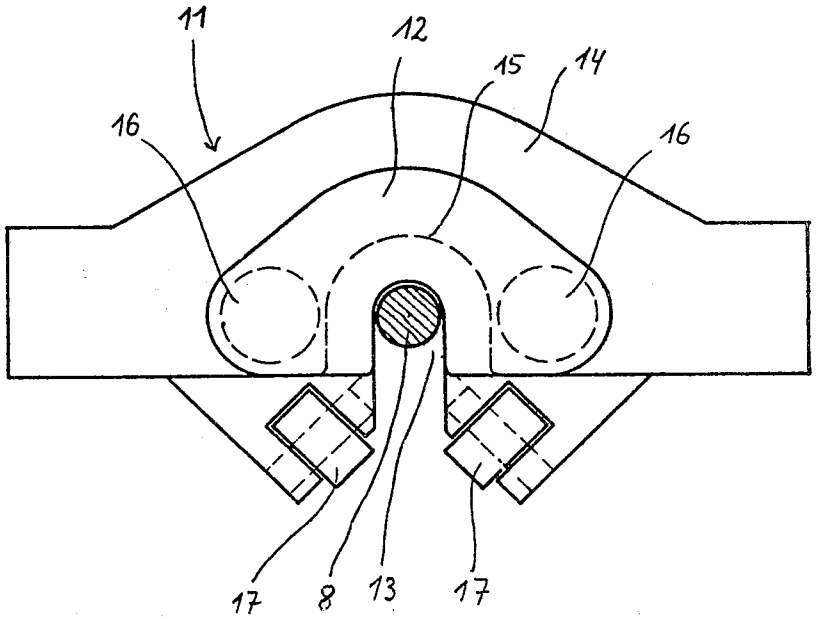
Figure 2:
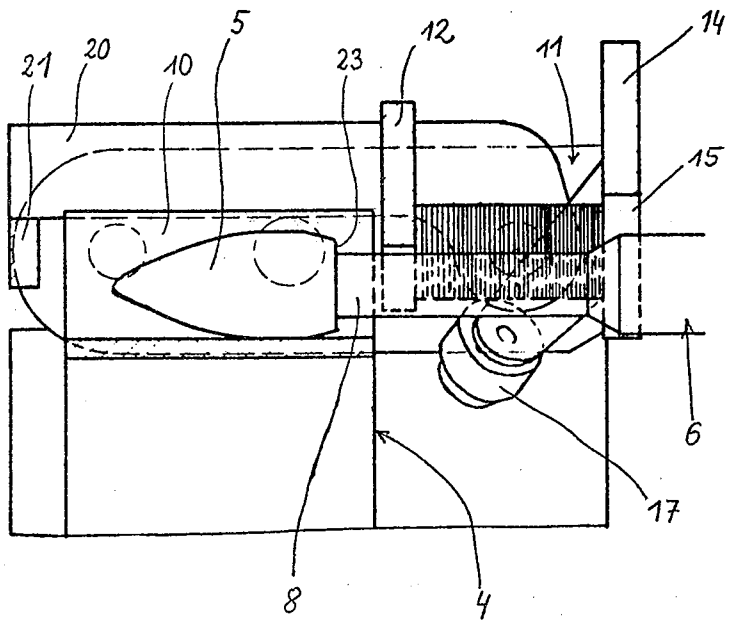
Figure 4:
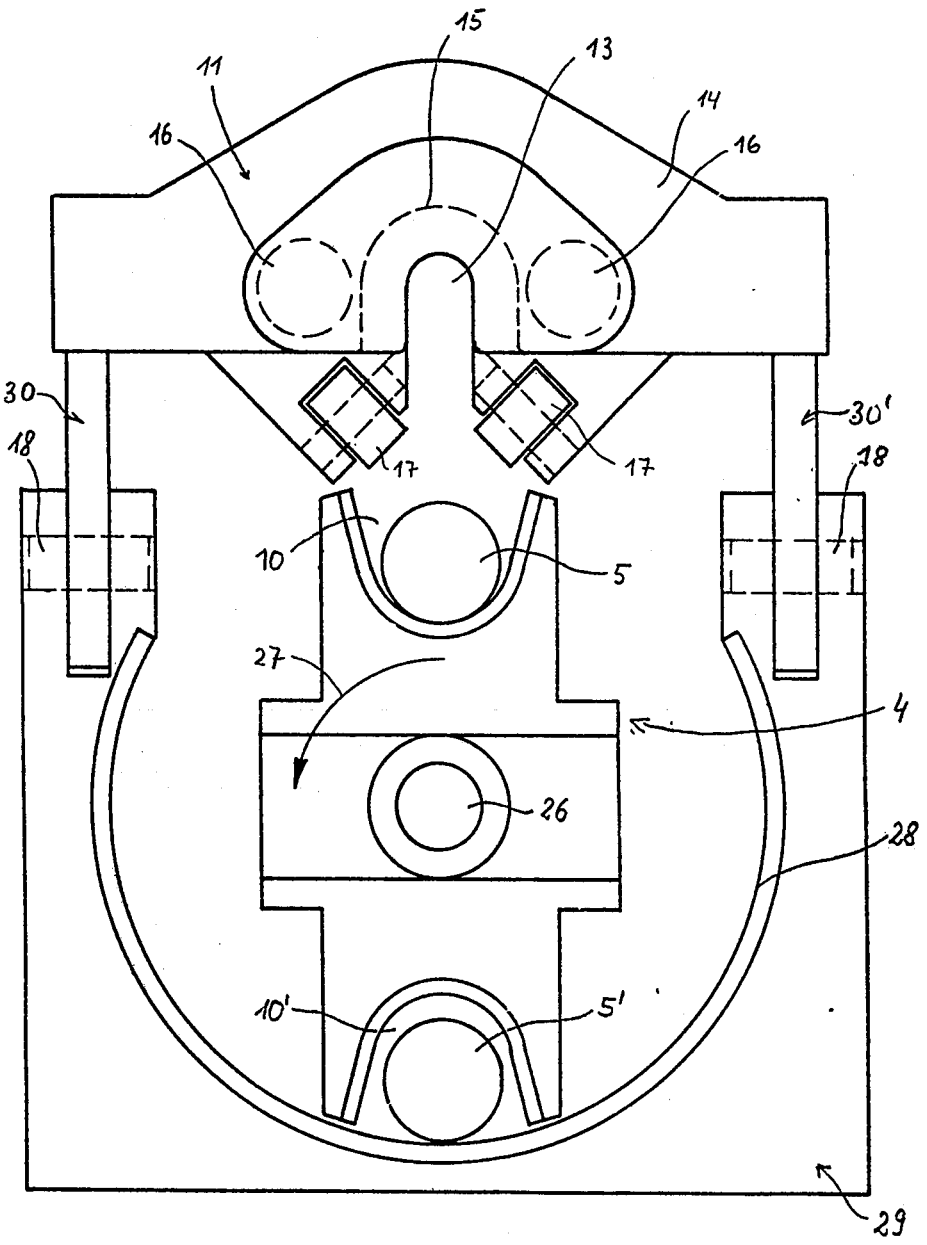
Figure 5:
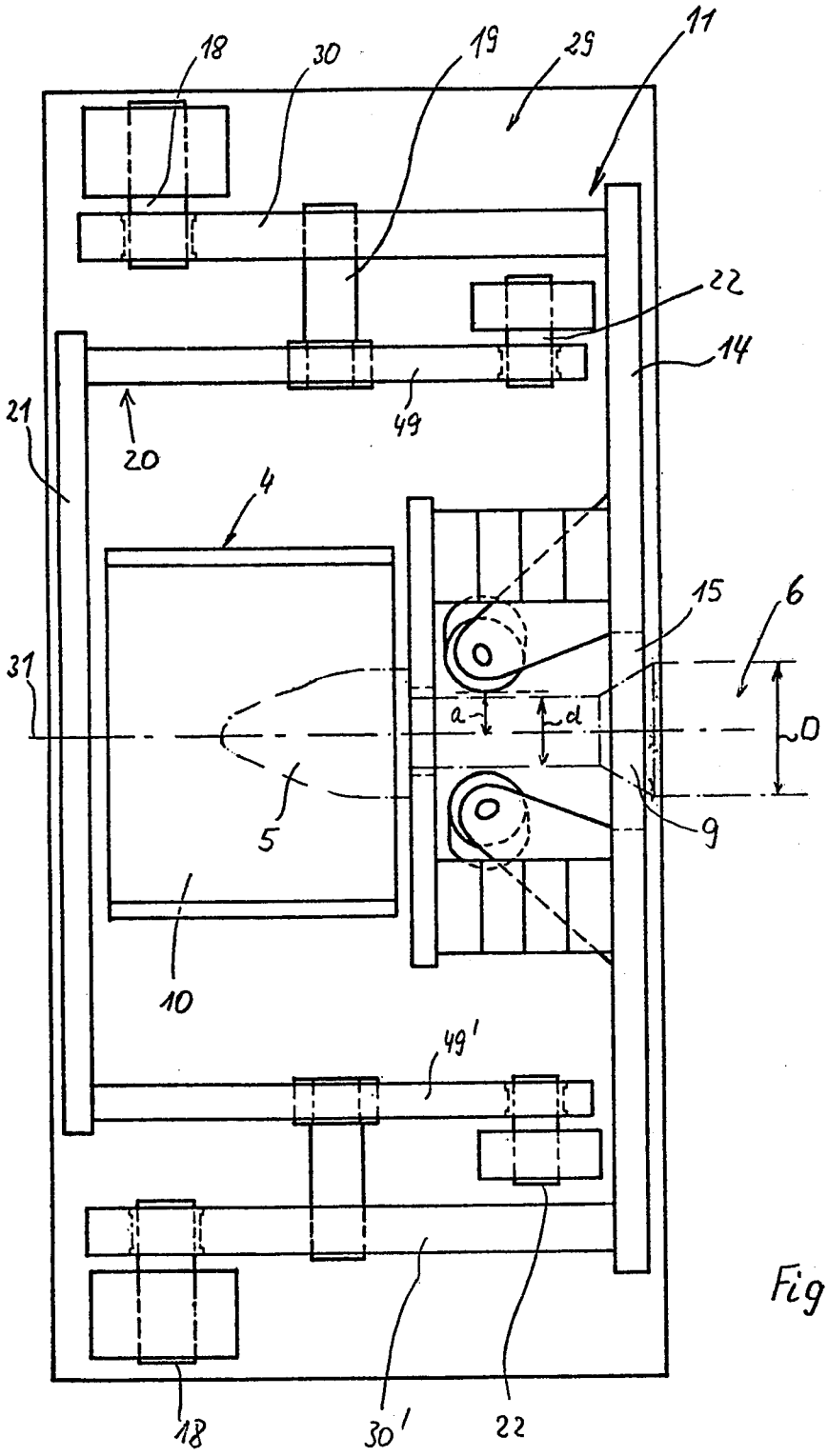
Figure 6:
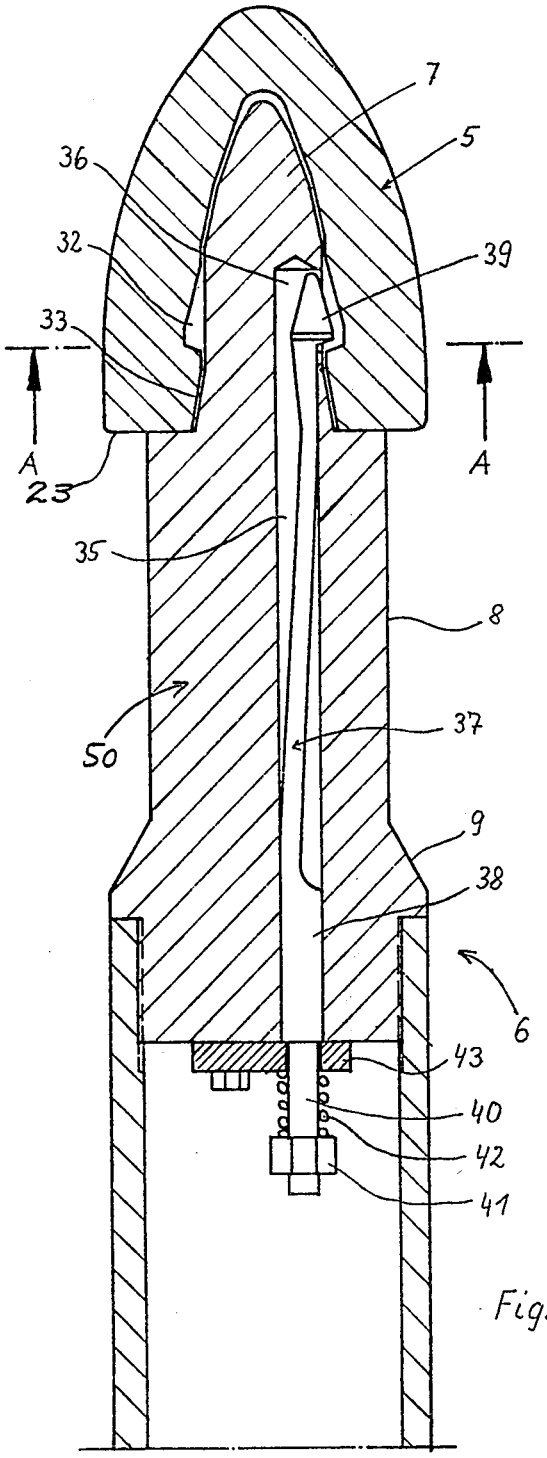
Figure 7:
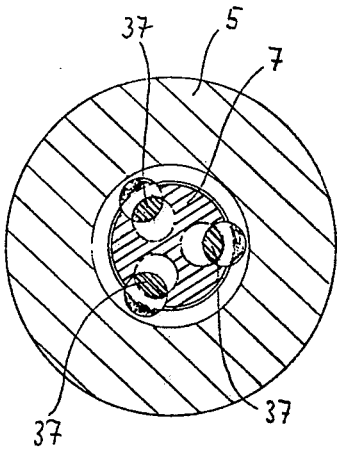
Figure 8:
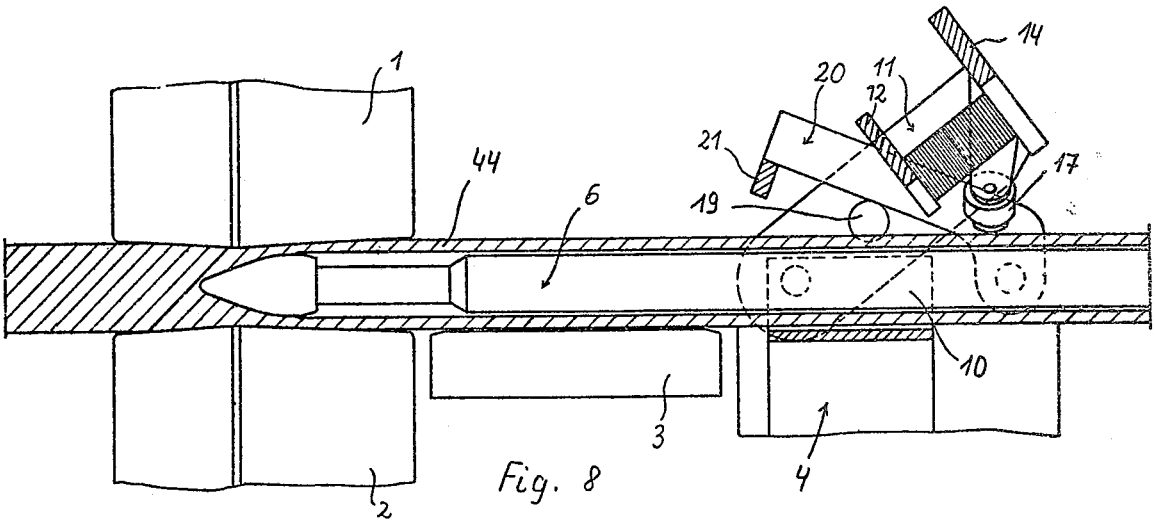
Figure 9:
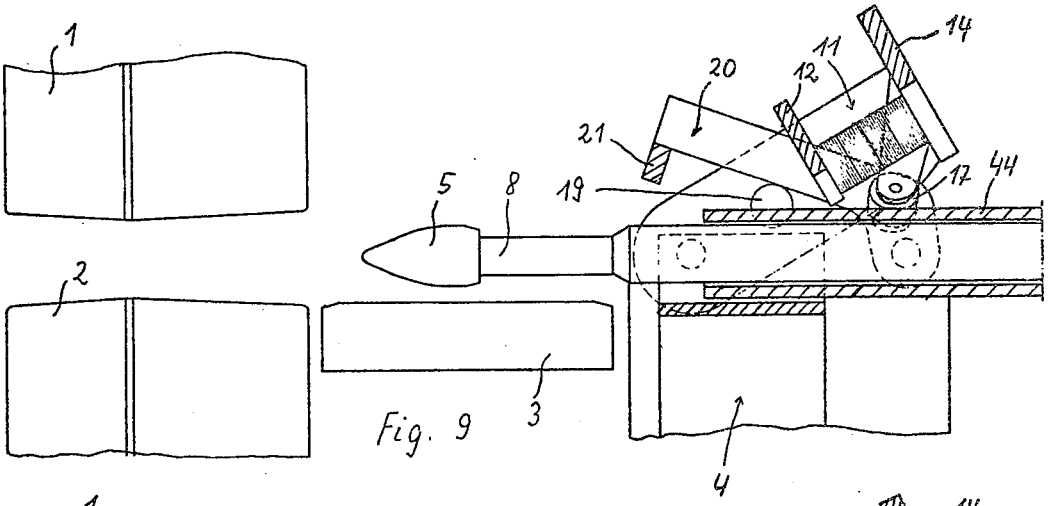
Figure 10:
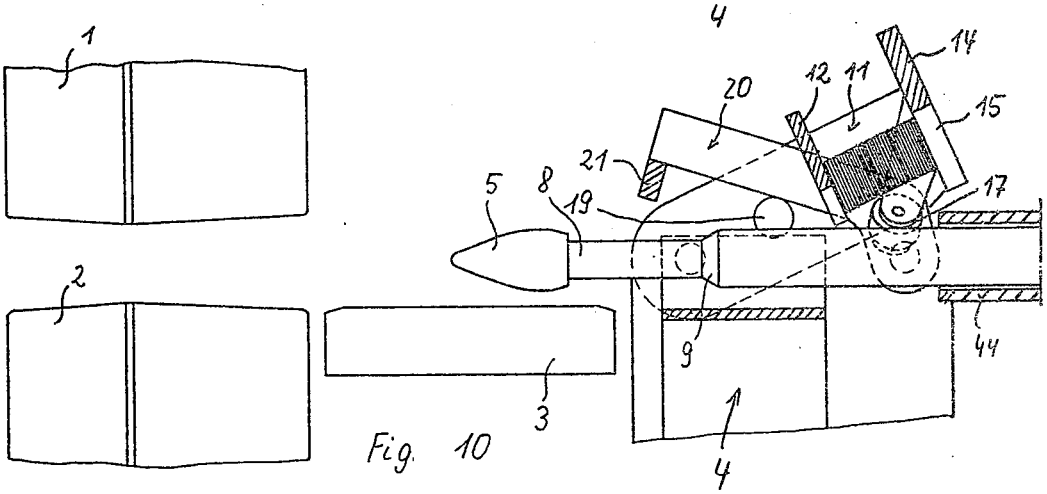
Figure 11:
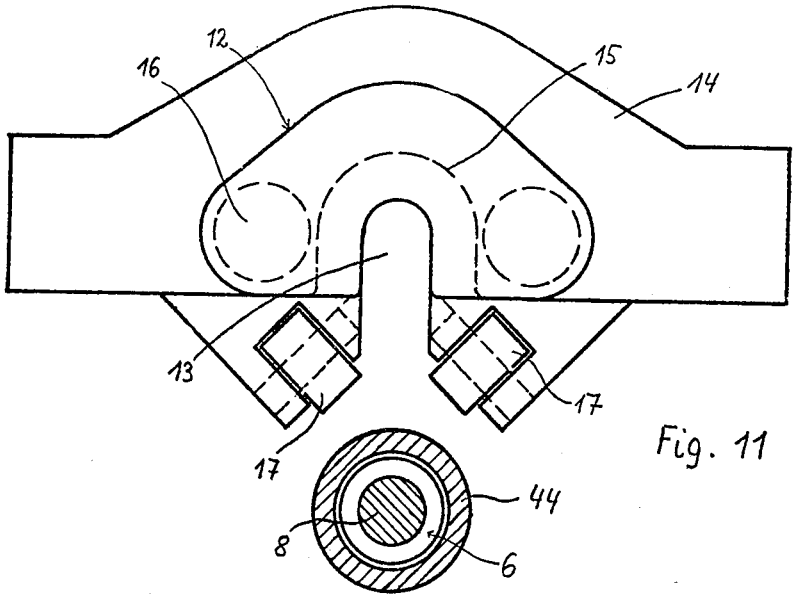
Figure 13:
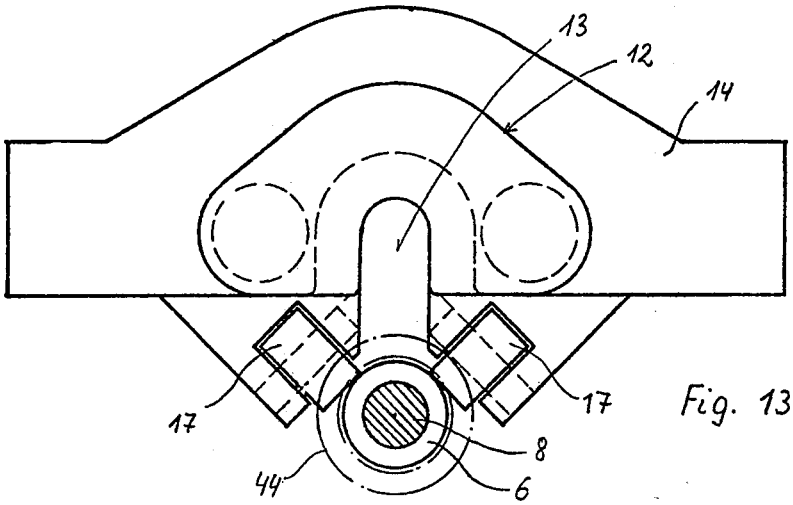
Figure 12:
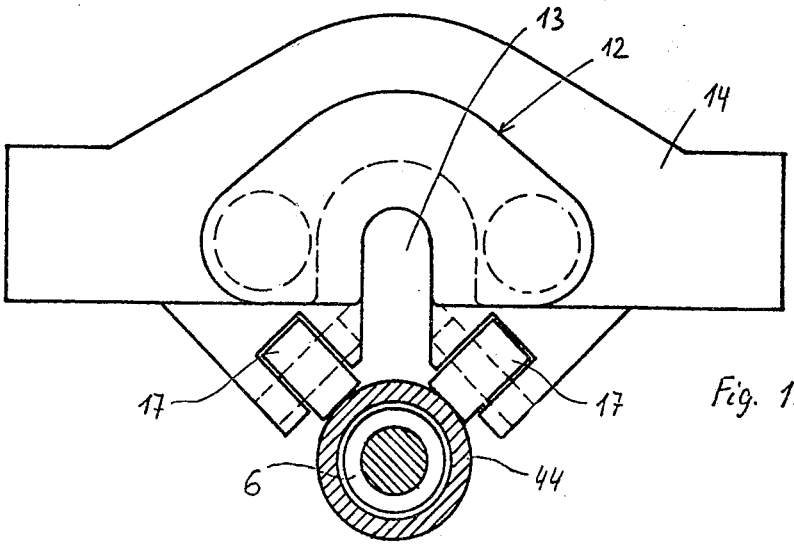

A detailed explanation of the invention is given in the following figures. These show in schematic representation in which:

FIG. 1 is a sectional view of a piercing rolling mill with a mandrel changing device constructed in accordance with the teaching of the present invention, FIG. 2 is a view of the rotating cylinder showing the recess closed by baffle plates, FIG. 3 is a partial sectional view of rolling direction, of the assembly shown in FIG. 2, FIG. 4 is the mandrel changing device seen in the rolling direction, FIG. 5 is a plan view of the mandrel changing device, FIG. 6 is a sectional view of the mandrel — mandrel rod connection, FIG. 7 is a sectional view along line A—A of FIG. 6, FIGS. 8 - 10 are views of three different rolling positions of the mandrel changing device, FIGS. 11 - 13 are partial sectional views in rolling direction, corresponding to FIGS. 8 - 10.

In FIG. 1 the two rolls 1 and 2 indicate the rolling stand of a piercing rolling mill, and 3 an intermediate support. The actual mandrel changing device consists of a change cylinder 4, which has a groove-like recess 10, in which a mandrel 5 is located ready for mounting. The mandrel 5 is mounted on the pin 7 of the mandrel rod 6 which has, at the part next to the mandrel 5 a constriction 8, which at the transition 9 changes over to the normal diameter of the mandrel rod 6. Furthermore, FIG. 1 shows a first lever 11 which can be raised by means of a swivel cylinder 24, and which has its swivel axis 18 perpendicular to the rolling line and within the range of the front end of the recess 10. A rear baffle plate 12, serving as stripper, is attached to the first lever 11 and has a fork-like shape in order to hold part 8 of the mandrel rod 6, next to the mandrel 5. One of two rollers 17 is visible at the lower side of the first lever 11 arranged in the rolling direction in front of the rear baffle plate. Furthermore, the first lever 11 has a cam 19 on which a second lever 20 is positioned. The second lever 20 carries the front baffle plate 21 at its front end, and its horizontal swivel axis 22 is perpendicular to the rolling line and is located in the range of the rear end of the recess 10.

A control device 46 controls the pressure supply 45 of the swivel cylinder 24 and receives corresponding signals through inputs 47 and 48. Further reference will be made to the control aspects hereafter.

FIG. 1 as well as FIG. 2 and FIG. 3 show, that the rear baffle plate 12 has a fork-like design and therefore a recess 13 which is dimensioned in such a way that the constriction 8 of the mandrel rod 6 has sufficient play. The rear baffle plate 12 is furthermore connected to the first lever 11 by means of buffer elements 16 which are supported by a cross beam 14. The cross beam 14 has a substantially larger fork-like opening 15. FIG. 2 shows how the recess 10 is essentially closed by the rear baffle plate 12 and by the front baffle plate 21. FIG. 4 shows the changing cylinder 4 which can be rotated around an axis 26 in the direction of an arrow 27, having two groove-like recesses 10 and 10' in which the respective mandrels 5 and 5' are located. The reference number 28 identifies a cooling cylinder containing a liquid coolant which cools the part of the changing cylinder 4 associated with the groove-like recess 10' as well as the mandrel 5'. The cooling cylinder 28 and the changing cylinder 4 are arranged in a corresponding frame 29.

The plan view shown in FIG. 5 illustrates that the levers 11 and 20 are formed by plates 30, 30' and 49, 49' respectively, arranged on both sides of the recess 10. FIG. 5 also indicates, that half of diameter d, i.e. the radius of the mandrel rod 6 in the range of the constriction 8, is smaller than the smallest lateral distance a between the roller 17 and the rolling line 31. FIG. 6 and FIG. 7 show the mandrel 5 — mandrel rod connection, namely an essentially hollow mandrel rod 6, into which an intermediate piece 50 is screwed. The intermediate piece 50 has the constriction 8 and, as shown in particular in FIG. 7, the axis-parallel bore holes 35, which change over into radial slots 36 at the pin 7. A spring 37 is located in each bore hole 35, and the cylindrical holding part 38 of the spring is clamped into the bore hole. At the front end, the spring protrudes by means of a holder under the force of the spring into an inner ring-shaped recess 32. The cylindrical part 39 of the spring 37 is recessed at the rear surface of the intermediate piece 50 and has contact with a thrust washer 43 attached there. The pin-shaped elongation 40 of the spring 37, which is smaller in diameter, has a threaded end, on which a nut 41 is screwed. A pressure spring 42 is clamped between the nut 41 and the thrust washer 43. The pressure spring 42 allows the spring 37 to yield in the direction of the axis when the connection between the mandrel 5 and the mandrel rod 6 is released. The pin 7 has a conical (tapered) shape, also in the rear area 33, in order to ensure a reliable (secure) mounting of the mandrel 5. If the mandrel 5 is released from the mandrel rod 6 or from the intermediate piece 50 respectively, the rear baffle plate 12, not shown here, impacts against the protruding part of the rear surface 23 of the mandrel 5.

The function of the invention shall now be described on the basis of FIGS. 8–13 with additional references to the other figures. In FIG. 8, a workpiece is being processed, and the already rolled part is designated as tube blank 44. The levers 11 and 20 are raised by the swivel cylinder 24 not shown here, as indicated in FIG. 11. As soon as the tube blank 44 is finished, the swivel cylinder is relieved by a corresponding control impulse, and the rollers 17 of the first lever 11 (FIG. 12) make contact with the tube blank 44 which moves further in the rolling direction, i.e. to the right. As soon as the tube blank 44 has reached the position shown in FIG. 10, the first lever 11 drops further down, and the rollers 17 (FIG. 13) now have contact with the mandrel rod 6 which moves further to the right. As soon as the rollers reach the constriction 8, they lose their contact with the mandrel rod 6 and cause the first lever 11 to fall until it reached the position shown in FIG. 2. The downward motion of the first lever 11 is followed by a corresponding downward motion of the second lever 20 which rests on the cam 19 and therefore follows the motion correspondingly. At the position shown in FIG. 2, the mandrel rod 6 continues to move further to the right, taking along the mandrel 5. The mandrel 5 impacts with its rear surface 23 against the rear baffle plate 12 and is released. In the event that the mandrel 5 should move forward, i.e. in the direction of its point, the front baffle plate 21 will prevent it from leaving the groove-like recess 10.

The changing cylinder 4 is now rotated, until a new groove-like recess 10 is lined up with the rolling line and a new, i.e. cooled mandrel 5, is made available according to FIG. 1. Together with the rotating impulse, the swivel cylinder also receives a corresponding impulse and moves the levers 11 and 20 into the position shown in FIG. 1 during the rolling process, where the rollers 17 have no contact with the workpiece or tube blank respectively.

It should be mentioned again, that the swivel cylinder 24 may of course be replaced by devices of similar functions.

In accordance with the provisions of the patent statutes, we have explained the principle and operation of our invention and have illustrated and described what we consider to represent the best embodiment thereof.

We claim:

1. In combination with a piercing rolling mill or the like and a mandrel changing device, which has at least two mandrel supporting members which can be alternately positioned in the rolling line of the mill in order to transfer mandrels to and from the rolling line, and wherein a mandrel rod carries at its front end a pin on which a mandrel is mounted in a manner to be quickly replaced by another, a mandrel stripper device comprising:

first means for restricting a mandrel from moving in one direction coaxially with the rolling line when supported by one of said supporting members positioned in said rolling line, second means for restricting a mandrel from moving in an axial direction opposite said first direction when supported by said one supporting member, a first lever for supporting said first restricting means, means for causing movement of said first lever so as to bring said first restricting means into and out of its operative position, a second lever for supporting said second restricting means, and means for causing movement of said second lever so as to bring said second restricting means into and out of its operative position, whereby when said restricting means are in their operative mandrel restricting positions said supported mandrel will be stripped from said mandrel rod and maintained in a predetermined position on said rolling line, and when said restricting means are in their inoperative non-mandrel restricting positions a mandrel, mandrel rod and tube blank are free to move in said rolling line.

2. In combination with a piercing rolling mill or the like according to claim 1 wherein said first and second levers each includes elements arranged on both sides of said rolling line, a means for each set of elements for rotatably supporting their associated lever, and cross members for each set of elements for interconnecting the elements of each set, said first and second restricting means being carried by an associated cross member.

3. In combination with a piercing rolling mill or the like according to claim 1, including means for rotationally mounting said first and second levers, and wherein the rotational axis of said first lever is arranged horizontally and in a perpendicular plane passing through the rolling line and closely adjacent to the longitudinal axial mill end of said one mandrel supporting member when positioned in said rolling line, said first lever includes a fork-shaped member adapted to encircle part of the mandrel rod adjacent to the mandrel when said first lever is in its operative position, at least one roller means mounted on said first lever adapted to succeedingly contact a tube blank and mandrel rod when said first lever is in its operative position, a cam means mounted on said first lever and arranged to support said second lever, said axis of rotation of said second lever being arranged horizontally and in a perpendicular plane passing through to the rolling line and closely adjacent the opposite longitudinal axial end of said one mandrel supporting member.

4. In combination with a piercing rolling mill or the like according to claim 3 wherein said mandrel rod immediately adjacent to a rod secured mandrel has a reduced portion whose axial extension is dimensioned in such a way so as not to be contacted by said roller means when said roller means is in its operative position, whereby said roller means can be brought into contact with a tube blank and the portion of the mandrel rod beyond said reduced portion, and when said reduced portion passes under said roller means said roller means will effect a predetermined positioning of said first and second restricting means with reference to a rod secured mandrel.

5. In combination with a piercing mill or the like according to claim 3 wherein the rotational axis of said first lever is arranged within the confines of the mill end of said one mandrel supporting member with respect to the rolling line and the rotational axis of said second lever is arranged within the confines of the opposite end of said one mandrel supporting member with respect to the rolling line.

6. In combination with a piercing rolling mill or the like according to claim 3, including a buffer element for connecting said first restricting means to said first lever.

7. In combination with a piercing rolling mill or the like according to claim 3 wherein said means for causing movement of said first and second lever includes a piston cylinder assembly connected to said first lever having a stroke sufficient to move said roller means to a position where a space exists between a rolled tube blank and said roller.

8. In combination with a piercing rolling mill or the like according to claim 7 including control means which includes means for effecting operation of said piston cylinder assembly to position said first and second levers in their operative positions on the completion of a rolling cycle, and means for positioning said first and second levers in their inoperative positions immediately after the completion of the mandrel stripping process and before the next rolling cycle.

* * * * *